United States Patent [19]

Engles

[11] Patent Number: 4,462,298

[45] Date of Patent: Jul. 31, 1984

[54] BULLET SIZING ATTACHMENT FOR ARBOR-TYPE PRESS

[76] Inventor: John D. Engles, P.O. Box 3782, Chula Vista, Calif. 92011

[21] Appl. No.: 449,398

[22] Filed: Dec. 13, 1982

[51] Int. Cl.[3] ..... F42B 31/02

[52] U.S. Cl. ..... 86/19; 86/24; 86/44

[58] Field of Search ..... 86/19, 23, 28, 25, 42, 86/43, 26, 27

[56] References Cited

U.S. PATENT DOCUMENTS

| | | | |
|---|---|---|---|
| 3,736,835 | 6/1973 | Hanson | 86/19 |
| 4,163,410 | 8/1979 | Dillon | 86/23 |
| 4,343,222 | 8/1982 | Dillon | 86/23 |

*Primary Examiner*—Stephen J. Lechert, Jr.
*Assistant Examiner*—Howard J. Locker
*Attorney, Agent, or Firm*—Ralph S. Branscomb

[57] ABSTRACT

A bullet sizing and lubricating attachment for an arbor-type bullet reloading press is provided, the attachment being mountable to an existing press such that the stroke of the bullet loading plunger is utilized to drive a bullet through a sizing die in which it is lubricated as it is sized.

5 Claims, 6 Drawing Figures

07
06
12
37
11
18
21
36
17
15
03
02
01
20
19
05
16
04
24
25
09
14
32
10
22
23
30
13
27
28
08

02
17
29
26

BULLET SIZING ATTACHMENT FOR ARBOR-TYPE PRESS

BACKGROUND OF THE INVENTION

Among gun aficionados there are also reloading fans who reload the shells of bullets of all sizes, both rifle and pistol. In order to reload a shell, the shell is put on a reloading arbor press, and a plunger forces the shell into a sizing die, while at the same time punching out the old primer. This step is necessary because the shell expands on firing.

The next step utilizes a different die which opens up the end of the shell to receive the bullet. The last step utilizes yet a third die, and it is this step, performed after the loading of the powder, in which the bullet is inserted into the shell and the shell crimped around the bullet, which is accomplished by yet a third die on the same arbor press.

As thus outlined, the process presumes that the reloader is using store-bought bullets. Some reloaders actually use bullets that they themselves mold from old bullets, battery plates, and other sources of scrap lead together with new lead. When the bullets are handmade it is necessary to size them by forcing them through a die that is exactly the right diameter to enable the bullet to match the muzzle. For bullet makers, there is a second piece of equipment in addition to the first arbor press which is used to actually shape the shell and force the bullet into the shell.

This second piece of equipment is a bullet sizing and lubricating press. This press costs almost as much as the first press, and if it could be eliminated, there would be an obvious cost savings. Although many reloaders enjoy the reloading process as a hobby all of its own, it is still based on cost savings. The cost of reloading bullets is only a tenth or even less than the cost of buying new bullets, representing a tremendous cost savings and enabling gun aficionados to spend long hours at the firing range without worrying about cost. Otherwise, many enthusiasts would be forced to stop after only a few minutes of shooting because at twenty cents to twenty-five cents a bullet, the cost adds up too fast.

For this reason it is obviously desirable to keep the cost of reloading equipment down as low as possible to enable more gun aficionados to reload their own shells.

SUMMARY OF THE INVENTION

The present invention fulfills the above-stated need by providing a bullet sizing and lubricating attachment which mounts on the existing reloading press, obviating the need for a second piece of equipment.

The attachment consists of a frame which mounts to the bullet shell support pedestal of the reloading press, and a die-holding mechanism which mounts to the top crossbar of the reloader. When a bullet is placed in the die, the reloader can be operated to first bring a punch which is mounted on the frame down to press the bullet into the die, and then by moving the actuator handle of the loader in the opposite direction, a plunger comes up through the bottom of the die and ejects the sized bullet. While this is going on, a cylinder of beeswax or other suitable lubricant injects the lubricant under pressure through a port in the side of the die housing to apply lubricant in the grooves of the bullet.

DETAILED DESCRIPTION OF THE PREFERRED EMBODIMENT

Figure 1:
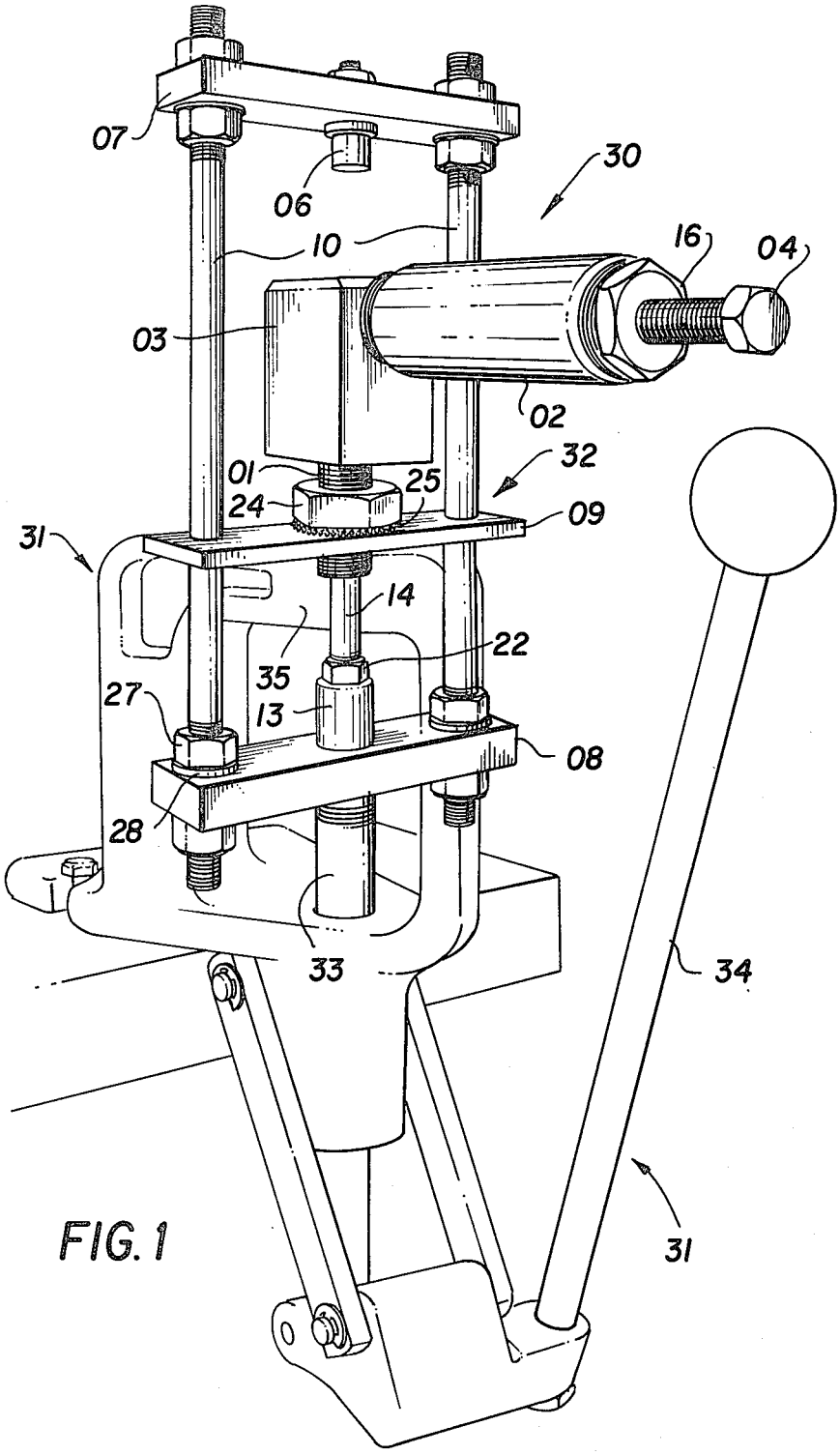
FIG. 1 is a perspective view of the attachment showing the bullet loading press in light lines.

As best shown in FIG. 1, the attachment 30 attaches to the existing bullet press 31 at two places, and there are two parts of the attachment which move relative to one another. The main frame 32 is engaged on the shell gripping pedestal 33 through the adaptor 13, which is shaped to replicate the bottom end of a shell so that it fits neatly within the gripping structure of the pedestal 33. The adaptor is then made secure by means of a set screw in the lower bridge bar 08. The frame 32 is made of the lower bridge bar 08, the upper bridge bar 07, and a pair of parallel upright rods 10 which rigidly secure the crossbars together by means of lock nuts 27 and lock washers 28. Mounted in the adaptor 13 is a plunger 14, retained by lock nut 22 and lock washer 23, and at the upper end of the frame is a punch 06 threadedly engaged in the crossbar 07. Thus as the pedestal of the press is moved up and down by manipulation of the actuator handle 34, the above-described structure which constitutes the frame moves up and down with it.

The second group of parts is stationary relative to the press, so that the frame moves relative thereto. It comprises a mounting sleeve 01 which engages in a threaded bore in the bridge 35 of the press 31. This bore is used ordinarily to thread in dies for shaping shells. The mounting sleeve is secured with lock nut and lock washer 24 and 25, respectively.

Figure 4:
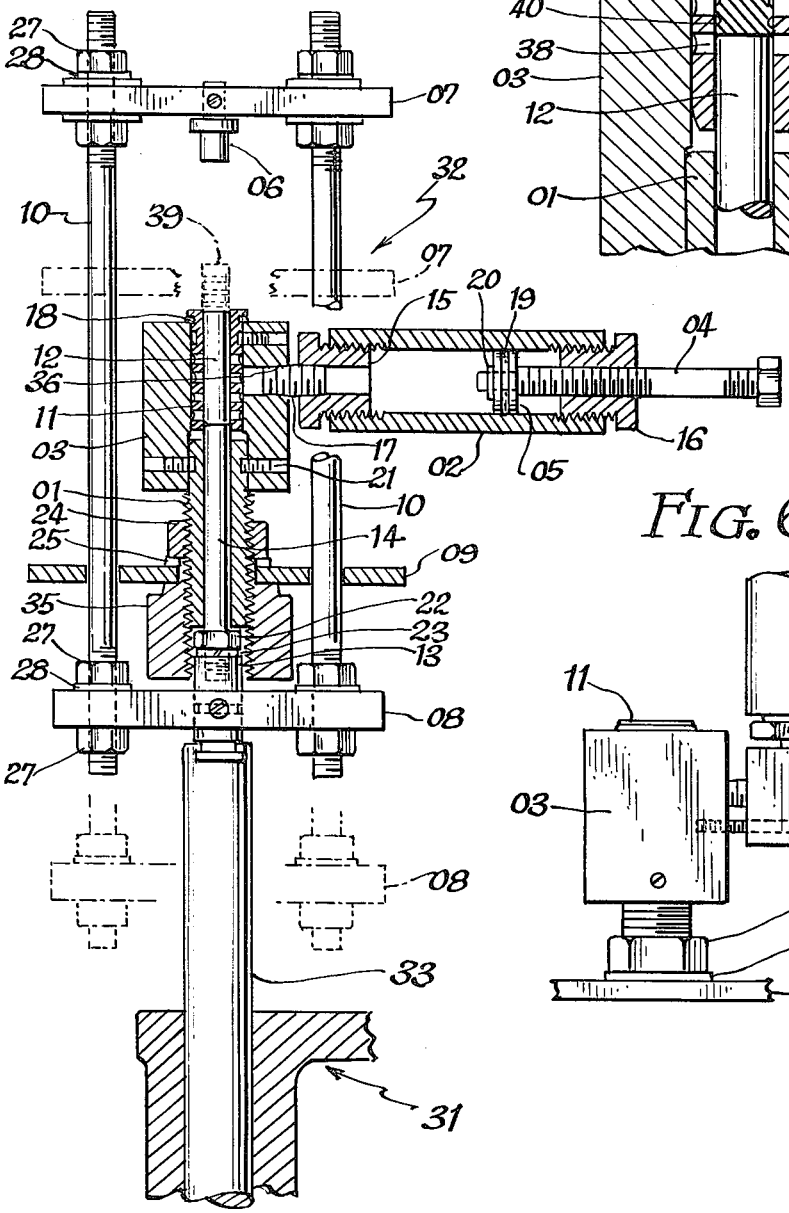
FIG. 4 is a vertical section through the attachment.

At the upper end of the mounting sleeve is an annular retaining groove which accepts a set screw to hold the sizing die housing 03 on the mounting sleeve. This structure is best seen in FIG. 4. The die housing houses die 11 which is the actual operative element in sizing and lubricating the bullets.

In the side of the housing is a bore 36 into which is threaded a nipple 17 which in turn is engaged in the bushing 15 of the lubrication cylinder 02. The lubrication in this cylinder is injected through the port defined by the nipple 17 by means of the piston 05, together with its sealing ring 19, its retaining clip 20, and the threaded piston shaft 04 which is engaged in the end plug 16. Clearly, by rotating the shaft 04 with a wrench, the pressure on the lubrication inside the cylinder 02 can be increased, and this is done after each group of several bullets have been sized and lubricated.

Figures 2, 3:
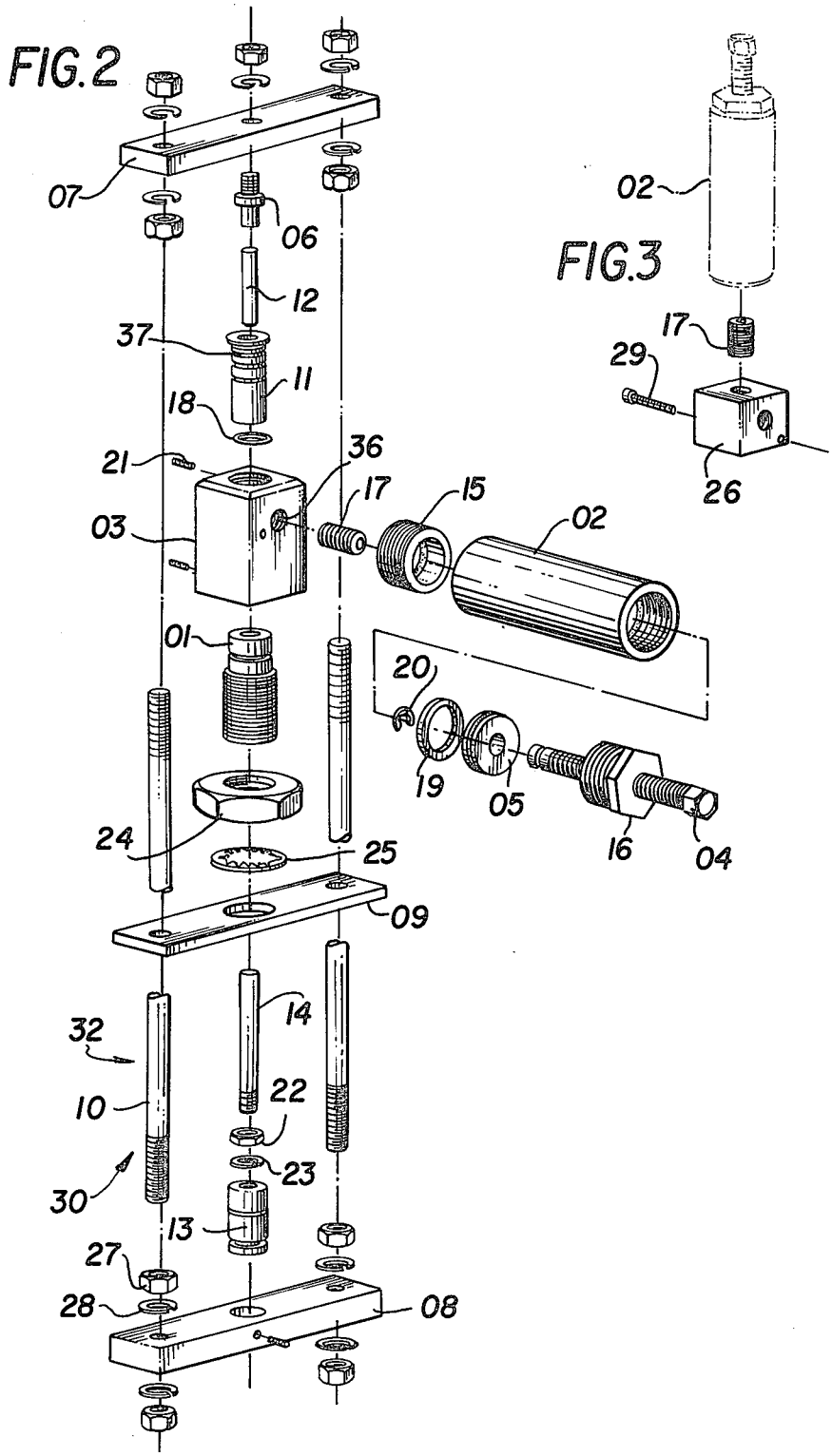
FIG. 2 is an exploded perspective of the attachment.
FIG. 3 is an exploded perspective of a right angle lubrication tube coupling.
Figure 6:
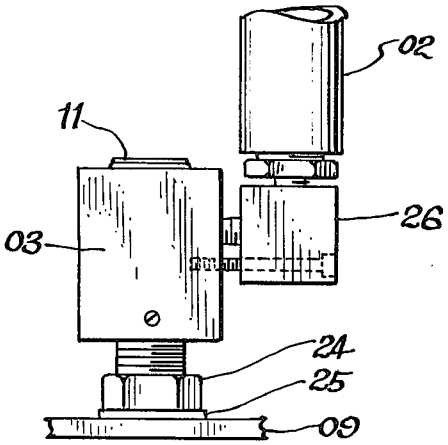
FIG. 6 illustrates the right angle lubrication tube attachment in place.

An alternative mode of mounting the cylinder is shown in FIG. 3, wherein a right angle lubrication tube coupling 26 can be mounted to the housing 03 by means of the bolt 29 as shown in FIG. 6. The purpose of this alternative mount is to accommodate different spatial requirements and it has no significant effect on the operational aspects of the unit.

The actual path of the lubrication from the lubrication cylinder passes through the annular rings 37 which are periodically perforated at 38 to permit passage of the lubrication from the exterior surface of the die through the holes to the exterior surface of the bullet. To prevent the lubrication from escaping through the bottom of the die, a traveling plug 12 is used which snugly fits inside the die and rides up and down to in effect displace the bullet and seal the inside of the die when the bullet is removed. For purposes of the claims, this plug was considered as part of the plunger 14, which it very well could be. Although not shown, however, in practice the plunger 14 is somewhat smaller in diameter than the plug 12 to avoid unnecessary friction in the system.

At the upper edge of the sizing die, an O-ring 18 seals the exterior of the die so that lubrication will not ooze out the top. The bottom length of the die, beneath the lowermost annular ring 37, is long enough to effectively prevent the escape of too much lubrication past the exterior bottom portions of the die.

Figure 5:
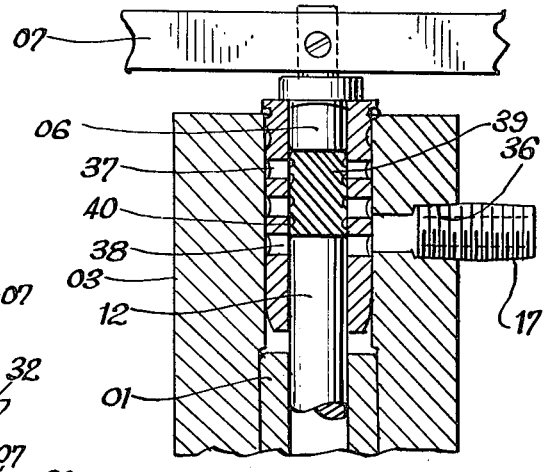
FIG. 5 is an enlarged section showing the sizing and lubricating die and associated structure.

In operation, a bullet 39 is placed atop the die, the actuator handle 34 is raised, which lowers the pedestal 33, drawing the frame 32 down with it, causing the punch 06 to force the bullet 39 into the die as shown in FIG. 5. The bullet displaces the plug 12 downward, as shown. Annular grooves 40 in the exterior surface of the bullet are filled, at least in part, with lubrication which is under a certain amount of pressure from the lubrication cylinder 02.

As the bullet is forced into the die as shown in FIG. 5, it is sized and lubricated. Then, upon lowering the actuator handle 34, the pedestal 33 moves upwardly, raising the frame with it, until the plunger 14, acting through the plug 12, ejects the bullet, and the mechanism is ready for its next bullet.

As described herein, and as claimed, upright, vertical, and horizontal directions are used to simplify the description and claiming of the attachment. However, clearly the device could be used on its side, or another arrangement of similar elements could be assembled to perform the same basic function sideways or upside down from the instant invention as described. Therefore, all dimensional references in the claims are hereby defined as reading strictly on the relative orientation of one part to another of the attachment, and are free of any limitations which might be otherwise read into the claims having to do with external references such as the force of gravity or the earth.

By the use of this attachment, a bullet reloading enthusiast having a press of the type illustrated herein can execute all steps of shell reloading with a single press, including the sizing and lubricating of the bullet itself. With a minimum of equipment, the shell reloader can now make his own bullets, and cheaply perform the entire reloading operation with a press which previously would only load store-bought bullets, or bullets already sized and lubricated on another piece of equipment.

While the preferred embodiment of the invention has been described, other modifications may be made thereto the other embodiments may be devised within the spirit of the invention and scope of the appended claims.

What is claimed is:

1. For an ammunition reloading press having a shell-holding pedestal with means to engage a shell thereon, actuator means for selectably raising and lowering said pedestal, and a bridge member defining a die socket spaced above and aligned with said pedestal, a bullet sizing attachment comprising:

(a) a bullet sizing die and means for engaging same in said socket to be loaded from above and having a bore through the bottom to pass a bullet ejecting plunger therethrough;

(b) a frame mountable to said pedestal to move therewith, and a portion thereof extending over said die and mounting a depending punch for forcing a bullet into said die;

(c) said frame also mounting a plunger above said pedestal for passing through said bore to eject a bullet from said die, whereby when said pedestal is forceably lowered, said punch forces a pre-positioned bullet into said die, and when said pedestal is raised, said plunger ejects said bullet from said die;

(d) said frame comprising a pair of strain-bearing upright rods mounted together in spaced parallelism by upper and lower crossbars, and said lower crossbar being mountable on said pedestal such that said upright rods carry the stress of forcing said bullet into said die with said plunger.

2. Structure according to claim 1 wherein said means for mounting said bullet sizing die in said socket also mounts a rod slideably seating said strain-bearing rods.

3. For an ammunition reloading press having a shell-holding pedestal with means to engage a shell thereon, actuator means for selectably raising and lowering said pedestal, and a bridge member defining a die socket spaced above and aligned with said pedestal, a bullet sizing attachment comprising:

(a) a bullet sizing die and means for engaging same in said socket to be loaded from above and having a bore through the bottom to pass a bullet ejecting plunger therethrough;

(b) a frame mountable to said pedestal to move therewith, and a portion thereof extending over said die and mounting a depending punch for forcing a bullet into said die;

(c) said frame also mounting a plunger above said pedestal for passing through said bore to eject a bullet from said die, whereby when said pedestal is forceably lowered, said punch forces a pre-positioned bullet into said die, and when said pedestal is raised, said plunger ejects said bullet from said die.

(d) said die further having a cylindrical bore to seat a bullet and being engaged in a die housing with a lubricant port through which lubricant is forced between said housing and said die, and including a portion of said plunger which is separated from the rest to define a sliding plug disposed in said cylindrical bore below said aperture and above the rest of said plunger to prevent escape of lubricant through the bottom of said cylindrical bore when the bullet is ejected to permit semi-automatic operation of said lubrication means.

4. A two-stroke method of sizing bullets on an ammunition reloading press having a shell holding pedestal with means to engage a shell thereon, actuator means for selectably and forceably raising and lowering said pedestal, and a cross member defining a die socket spaced above and aligned with said pedestal, comprising the following steps:

(a) engaging a top loaded bullet sizing die with a bullet ejector plunger bore through the bottom thereof in said socket, said die having at least one lubrication groove communicating with a pressurized lubrication source, and a cylindrical plug slideable in said bore to block said groove until displaced by a bullet forced down into said bore;

(b) mounting a frame on said pedestal, said frame having a portion thereof extending over said die and mounting a depending punch for forcing a bullet into said die, and a portion extending under said die and mounting an upright bullet ejecting plunger aligned with said bore;

(c) placing a bullet on said die;

(d) operating said acutator means a first time to lower said pedestal, frame and punch to force said bullet into said die, and displace said plug, causing said bullet to be lubricated; and (e) operating said actuator means a second time to raise said pedestal to drive said plunger through said bore to eject said bullet from said die.

5. A method according to claim 4 wherein said die has a lubricant cylinder ported to the inside thereof in continuous communication with said lubrication groove with an injector piston on a threaded shaft which extended through the end of said cylinder in threaded engagement therewith, and including the step of periodically rotating said shaft to inject more lubricant into said socket to increase the pressure in said cylinder to lubricate several more bullets without requiring repeated rotation of said shaft for each bullet.

* * * * *